United States Patent [19]

Janik

[11] 4,216,979

[45] Aug. 12, 1980

[54] BANK CHECKING SYSTEM

[76] Inventor: Daniel Janik, 1861 S. 3rd East, Salt Lake City, Utah 84115

[21] Appl. No.: 27,527

[22] Filed: Apr. 5, 1979

[51] Int. Cl.[2] ..... B42D 15/00

[52] U.S. Cl. ..... 283/58; 281/1; 150/35

[58] Field of Search ..... 150/10, 26, 35, 39; 281/1 R; 283/57, 58, 61, 62

[56] References Cited

U.S. PATENT DOCUMENTS

| | | | |
|---|---|---|---|
| 1,271,998 | 7/1918 | Benson | 283/57 |
| 2,496,144 | 1/1950 | Bauman | 150/35 |
| 3,433,279 | 3/1969 | Seamon | 150/39 |
| 3,847,195 | 11/1974 | Tyrseck | 150/39 |

FOREIGN PATENT DOCUMENTS

| | | | |
|---|---|---|---|
| 181262 | 2/1936 | Switzerland | 283/1 R |
| 1371140 | 10/1974 | United Kingdom | 150/39 |

*Primary Examiner*—Paul A. Bell
*Attorney, Agent, or Firm*—Trask & Britt

[57] ABSTRACT

A bank checking system for carrying and recording standard size checks is adapted for storage in a pocket compartment of a wallet. The system includes a cover member which may be opened and closed on a fold line. One half of the folding member holds a plurality of sequentially numbered, standard size checks folded and stacked such that they may be removed in sequence without disturbing the remaining checks. The other half of the folding member holds a register including a continuous sheet folded into collapsible segments.

7 Claims, 3 Drawing Figures

BANK CHECKING SYSTEM

BACKGROUND OF THE INVENTION

1. Field:

The present invention relates generally to checking systems. It specifically provides such a system which stores standard size checks in folded condition within a miniature checkbook cover.

2. State of the Art:

Various devices for carrying checks and check registers are presently in use. The checks currently in use are of various sizes, but these sizes are somewhat standardized by banking institutions. Many of the checks in common use are approximately the size of paper currency. Carrying loose checks in a billfold or wallet is unsatisfactory because it is important that a register be maintained on a current basis as checks are written. However, none of the available checking systems are designed to be inserted into a pocket compartment of a standard size wallet.

There remains a need for a bank checking system for storing checks and recording checking transactions, using standard size checks, but which is small and compact enough to be inserted into a pocket compartment of a standard size wallet.

BRIEF SUMMARY OF THE INVENTION

The present invention provides a novel bank checking system comprising a folding cover member generally similar in function to a conventional checkbook cover but adapted for storage in a pocket compartment of a billfold or wallet. The cover member carries two pockets or similar receiver means to hold, respectively, a plurality of sequentially numbered checks and a checking register. These pockets are associated with opposing halves of the folding member and are preferably provided with transparent window panels. The checks are individually folded, approximately in thirds, and are arranged in a stacked relationship so that an individual check may be selectively removed without disturbing the remaining checks. A bank guarantee card may be stored within the check pocket so that it is readily visible through a window panel for check cashing purposes. Identifying information printed on the register may be similarly displayed through the window panel of the register pocket.

DETAILED DESCRIPTION OF THE ILLUSTRATED EMBODIMENTS

Figure 1:
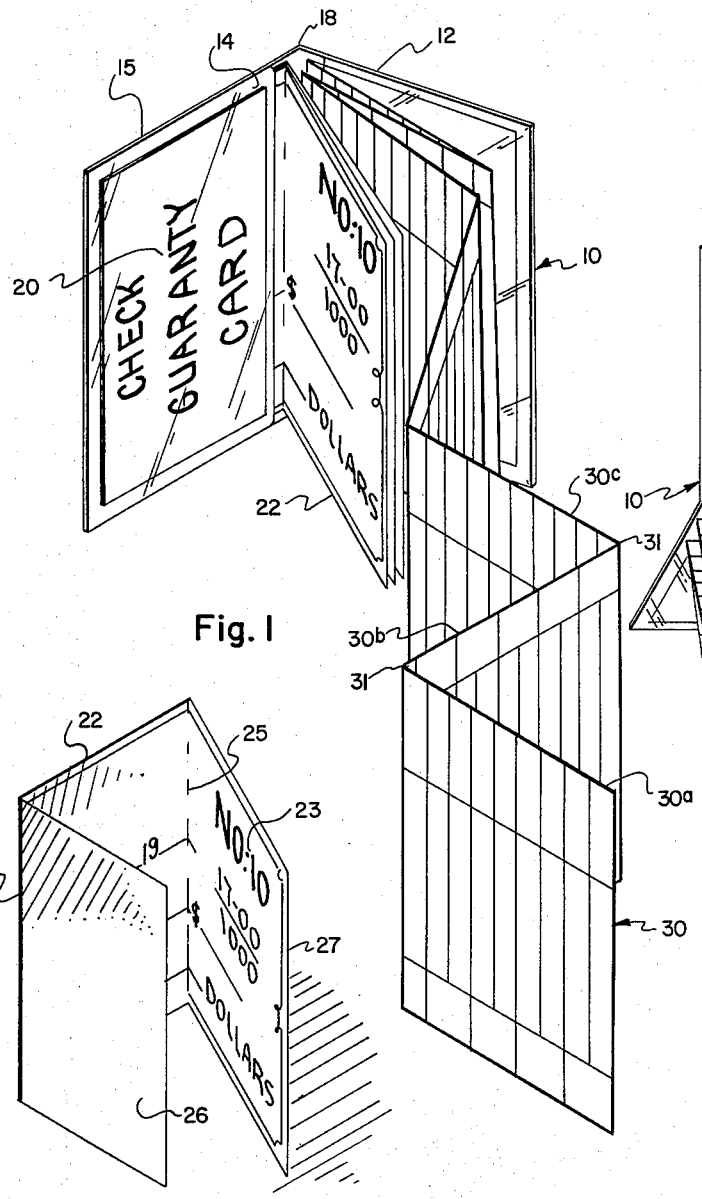
FIG. 1 is a perspective view of a bank checking system of this invention opened to expose its constituent parts.
Figure 2:
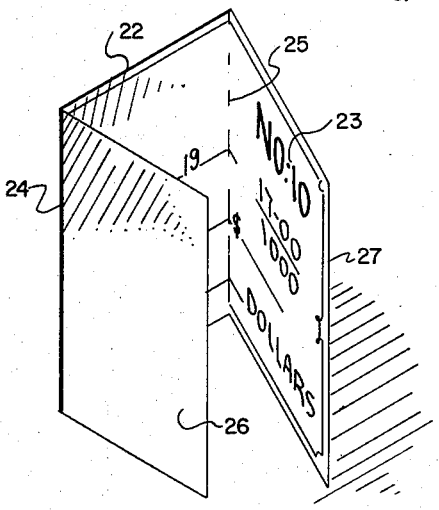
FIG. 2 is a perspective view showing the manner in which standard size checks are folded in accordance with this invention.

Referring to the drawings, the numeral 10 designates generally a novel bank checking system of this invention. A folding cover member 12 carries receiving means 14 on one of its sides 15 and similar receiving means 16 on its other side 17. The sides 15, 17 mutually open and close along a fold line 18 which divides the member 12 into approximately equal halves. As illustrated, each of the receiver means 14, 16 is formed as a pocket, and each pocket includes a transparent window to display a bank guarantee card 20, and the top of a check register 21, respectively.

Figure 3:
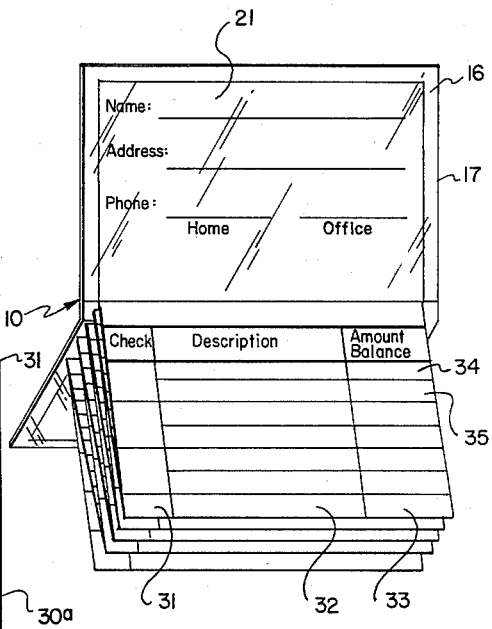
FIG. 3 is a perspective view of the bank checking system of this invention illustrating the register means in collapsed or stored condition.

FIG. 3 illustrates a standard check 22, carrying indicia 23 near a corner of its face. The check 22 is foldable along a pair of approximately parallel fold lines 24, 25 so that a first segment 26 includes less than one third of the area of the check 22. This first segment 26 is folded over against the face of the check 22, and a second segment 27 of the check 22 is foldable towards said first segment 26. When inserted in the pocket 14, the plurality of checks 22 are held in a stacked arrangement such that this first segment 26 of each (except the first) is held between the face of that check and the back of an adjacent folded check. The second segment 27 of each check is oriented parallel the corresponding second segments 27 of the others of said plurality of checks 22 so that they may be folded simultaneously for containment between the pocket 14 and the register 21. Any one of the checks 22 may selectively be removed from the stacked arrangement without disturbing the remaining checks 22.

The register means 21 includes a continuous sheet 30 folded into segments **30*a*, 30*b*, 30*c*, . . . defined by a series of approximately parallel fold lines 31. Alternating segments 30 of the register means 21 are folded in opposite directions so that the entire sheet may be collapsed for containment between the halves of the folding member 12 when it is closed. The register 21 may be extended flat to enter data when the folding member 12** is opened.

In a preferred embodiment, the windows of pockets 14 and 16 are comprised of transparent panels with a rough surface to resist ink transferance from the register means 21.

The register 21 ordinarily includes a column 31 for recording the check number (indicia 23) or deposit date, a column 32 for a description of the transaction, and a column 33 for entering the amounts of each transaction in a first line 34 and carrying forward a balance in a second space 35 associated with the transaction. A "date" column may also be provided, if desired.

Typical overall dimensions for a closed folding cover member 12 designed to accommodate standard size checks, approximately $2\frac{3}{4}\times 6$ inches are approximately $2\frac{1}{2}\times 3\frac{3}{4}$ inches. Although these dimensions may be varied to accommodate checks of larger or smaller size, they are generally preferred because they readily accommodate standard size bank guarantee cards (approximately $2\frac{1}{4}\times 3\frac{1}{2}$ inches) and also enable the entire system to be inserted into a pocket compartment of most wallets.

Reference herein to details of the illustrated embodiment should not be taken as limiting the appended claims which themselves recite those features regarded as essential to the invention.

I claim:

1. A bank checking system comprising:

a cover member which may selectively be opened and laid out flat and closed by folding along a fold line which divides said member into approximately equal halves, each said half carrying receiver means for holding components of said system between said halves when said folding member is closed;

a plurality of bank checks, each carrying indicia near a corner of its face, and each foldable along a pair of approximately parallel fold lines so that a first segment including less than one-third the area of the check is folded over against the face of the check, and a second segment, opposite said first segment and including said indicia is foldable towards said first segment, said plurality of checks being held in stacked arrangement by one of said receiver means such that the first said segment of each check is held between the face of that check and the back of an adjacent check and the second segment of each check is oriented parallel the corresponding second segments of the other of said plurality of checks so that they may be folded simultaneously for containment between the halves of said folding member when said folding member is closed and unfolded when said folding member is opened so that any of said checks may selectively be removed from said stacked arrangement without disturbing the remaining checks; and register means, including a continuous sheet held by the other of said receiver means and folded into segments defined by a series of approximately parallel fold lines, alternating segments being folded in opposite directions so that the entire sheet may be collapsed for containment between the halves of said folding member when said folding member is closed and extended for the entry of data when said folding member is opened.

2. A system according to claim 1 wherein one of said receiver means is configurated as a pocket to receive the first segment of said register, said pocket includes a window, and the portion of said segment adjacent said window carries identifying information.

3. A system according to claim 2 wherein said window comprises a transparent window panel with a rough surface to resist ink transference from said register.

4. A system according to claim 1 wherein one of said receiver means is configurated as a pocket to receive the portions of said checks including the folded over first segments thereof in stacked arrangement.

5. A system according to claim 4 wherein said pocket includes a window, and is adapted to receive a check guaranty card between said checks and said window so that information on said card is visible through said window.

6. A system according to claim 5 wherein said window comprises a transparent window panel with a rough surface to resist ink transference from said register.

7. A system according to claim 4 wherein the other of said receiver means is configurated as a pocket to receive the first segment of said register, said pocket includes a window, and the portion of said segment adjacent said window carries identifying information.

* * * * *